US010414541B2

(12) United States Patent
Kroeker

(10) Patent No.: US 10,414,541 B2
(45) Date of Patent: Sep. 17, 2019

(54) QUAD FOOT NESTABLE BLOCK PALLET

(71) Applicant: William Newton, Wichita, KS (US)

(72) Inventor: Dan Kroeker, Hutchinson, KS (US)

(73) Assignee: COTAJETY LLC, Valley Center, KS (US)

( * ) Notice: Subject to any disclaimer, the term of this patent is extended or adjusted under 35 U.S.C. 154(b) by 0 days.

(21) Appl. No.: 15/981,742

(22) Filed: May 16, 2018

(65) Prior Publication Data

US 2018/0334284 A1 Nov. 22, 2018

Related U.S. Application Data

(60) Provisional application No. 62/507,206, filed on May 16, 2017.

(51) Int. Cl.
*B65D 19/00* (2006.01)

(52) U.S. Cl.
CPC ..... *B65D 19/0018* (2013.01); *B65D 19/0075* (2013.01); *B65D 2519/00034* (2013.01); *B65D 2519/00069* (2013.01); *B65D 2519/0094* (2013.01); *B65D 2519/00129* (2013.01); *B65D 2519/00268* (2013.01); *B65D 2519/00273* (2013.01); *B65D 2519/00288* (2013.01); *B65D 2519/00293* (2013.01);
(Continued)

(58) Field of Classification Search
CPC ..... A47B 87/0207; B65D 2519/0049; B65D 2519/00935; B65D 2519/0096; B65D 2519/00955; B65D 2519/0094
USPC ..... 108/53.5, 53.3, 53.1, 91, 92
See application file for complete search history.

(56) References Cited

U.S. PATENT DOCUMENTS 2,605,158 A 7/1952 Nash
3,641,949 A * 2/1972 Monk ..... B65D 19/0018 108/53.3
(Continued)

FOREIGN PATENT DOCUMENTS

BE 1013907 12/2002
DE 2211902 1/2003
(Continued)

OTHER PUBLICATIONS

PCT International Search Report, PCT/US18/33058, dated Aug. 10, 2018.
(Continued)

*Primary Examiner* — Jose V Chen
(74) *Attorney, Agent, or Firm* — Jeffrey L. Thompson; Thompson & Thompson, P.A.

(57) ABSTRACT

A pallet has a rectangular pallet deck with a generally planar upper surface, and a plurality of pallet feet connected by shear members at the four corners. The pallet has an open bottom with a clear span between the pallet feet to allow multiple pallets to be nested together. The pallet feet each have an L-shaped cross section. Holes are formed in the pallet deck to accommodate pallet feet of other pallets when the pallets are nested together. In one embodiment, pallets are nested together by offsetting the pallets in a longitudinal direction. In another embodiment, pallets are nested together by rotating the pallets a quarter turn relative to each other. A metal reinforcement frame is provided inside a plastic exterior to provide increased strength and reduced deflection.

9 Claims, 17 Drawing Sheets

(52) U.S. Cl.
CPC ..... *B65D 2519/00323* (2013.01); *B65D 2519/00338* (2013.01); *B65D 2519/00437* (2013.01); *B65D 2519/00467* (2013.01); *B65D 2519/00562* (2013.01); *B65D 2519/00572* (2013.01)

(56) References Cited

U.S. PATENT DOCUMENTS 3,675,595 A * 7/1972 Sullivan ..... B65D 19/0018 108/53.1
3,709,160 A * 1/1973 Howard ..... B65D 19/0018 108/53.3
3,814,031 A 6/1974 Fowler
3,867,887 A * 2/1975 Saidel ..... B65D 19/0028 108/53.3
3,926,321 A * 12/1975 Trebilcock ..... B65D 71/70 108/53.1
4,226,192 A * 10/1980 Myers ..... B65D 19/0018 108/53.1
4,301,743 A * 11/1981 Keller ..... B65D 19/0095 108/53.1
4,890,560 A * 1/1990 Good ..... B65D 19/0097 108/53.1
5,341,748 A 8/1994 Liu
5,445,396 A * 8/1995 Sebor ..... B62B 3/16 108/53.3
5,606,921 A 3/1997 Elder et al.
5,746,139 A * 5/1998 Villanueva ..... A47B 45/00 108/102
5,823,549 A * 10/1998 Morgan, Jr. ..... B62B 3/16 280/33.998
5,921,188 A * 7/1999 Kohlhaas ..... B65D 19/0075 108/52.1
6,024,223 A * 2/2000 Ritter ..... B65D 19/18 206/386
6,199,487 B1 * 3/2001 Coddington ..... B65D 19/0016 108/53.1
6,234,088 B1 * 5/2001 Bredal ..... B65D 19/0018 108/53.3
6,257,152 B1 * 7/2001 Liu ..... B62B 3/16 108/53.3
6,807,911 B2 10/2004 Carson et al.
6,979,005 B1 * 12/2005 McLerran ..... B62B 3/00 108/53.1
2008/0308015 A1 12/2008 Apps
2010/0196134 A1 * 8/2010 Stahl ..... B65D 19/004 414/800
2012/0260462 A1 10/2012 Nielsen
2013/0081971 A1 * 4/2013 Ritzberger ..... B65D 19/02 206/511
2013/0284635 A1 10/2013 Frankenberg
2015/0048288 A1 2/2015 Magoto et al.
2015/0135999 A1 * 5/2015 Takyar ..... B65D 19/0018 108/53.3
2018/0251259 A1 * 9/2018 Shuert ..... B65D 19/0018

FOREIGN PATENT DOCUMENTS

GB 2530810 4/2016
KR 101227672 1/2013

OTHER PUBLICATIONS

ORBIS, Powered by Menasha Corporation; A Shift in Thinking, 2017 Product Selection Guide; Bulkpak, Hand-Held Containers, Pallets, Orbidhield Protective Dunnage; ORBIS Corporation is a subsidiary of Menasha Coproration, printed in the U.S.A.

* cited by examiner

QUAD FOOT NESTABLE BLOCK PALLET

RELATED APPLICATIONS

This application claims the benefit of U.S. Provisional Patent Application No. 62/507,206 filed on May 16, 2017. The entire contents of the related application are incorporated herein by reference.

BACKGROUND OF THE INVENTION

Field of the Invention

The present invention relates generally to pallets, and in particular to a reusable pallet suitable for use in pallet pooling arrangements.

Description of the Related Art

Pallets are flat transport structures that support materials and/or goods while being lifted or otherwise manipulated by material handling equipment, such as a forklift, pallet jack, or front loader. Pallets generally have a planar supporting surface and feet or runners that elevate the supporting surface above the ground to protect the supported goods from coming into contact with moisture, dirt and debris. Goods can be placed on a pallet, secured with strapping or stretch wrap, and shipped. Four-way pallets allow pallet jacks and forklifts to approach the pallets from any side to move them. Pallets can be made of a variety of materials, including wood, plastic and metal.

Pallet pooling is the shared use of standard pallets among multiple customers. Pallet pooling has become common to allow pallet users to outsource the expense, labor and skills required to deal with a high volume of pallets and focus on their core business. In pallet pooling arrangements, a pallet management company provides pallet users or shippers with reuseable pallets at one end of a supply chain (e.g., at the user's warehouse). The reuseable pallets are then retrieved by the pallet management company at the other end of the supply chain (e.g., at retail store locations). The pallets are then inspected, cleaned and reconditioned as needed, and then sent back into the supply chain for use by the same user or other users. In larger organizations, the empty pallets are transported by semi-loads to and from various locations in the supply chain. A standard 53'×102"×9' dry van trailer will hold approximately 540 conventional block pallets.

There is a need for an improved pallet that can be nested when stacked in a semi-load of empty pallets, while still meeting or exceeding all of the functional requirements of a standard block pallet.

SUMMARY OF THE INVENTION

An object of the present invention is to provide a nestable block pallet that allows a greater number of pallets to be transported in a semi-load of empty pallets.

A further object of the present invention is to provide a block pallet having a pallet deck with sufficient strength that the pallet only needs to be supported by feet located at the four corners of the pallet during use.

A further object of the present invention is to provide a block pallet having a pallet deck with a metal reinforcement frame inside a plastic exterior to provide increased strength.

A further object of the present invention is to provide a shearable foot feature that allows a foot of the pallet to become detached before damaging the pallet deck.

A further object of the present invention is to provide a nestable pallet having a foot design and holes in the pallet deck that allow pallet feet to slip through the deck top when pallets are nested together.

A further object of the present invention is to provide a block pallet having feet with a rack gripping foot tread design to prevent the pallet from slipping.

Numerous other objects of the present invention will be apparent to those skilled in this art from the following description wherein there is shown and described embodiments of the present invention, simply by way of illustration of some of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the present invention is made with reference to the accompanying drawings. In the drawings.

DETAILED DESCRIPTION OF THE INVENTION

A quad foot nestable block pallet 10, 10' according to embodiments of the present invention will now be described in detail with reference to FIGS. 1 to 23 of the accompanying drawings.

Figure 1:
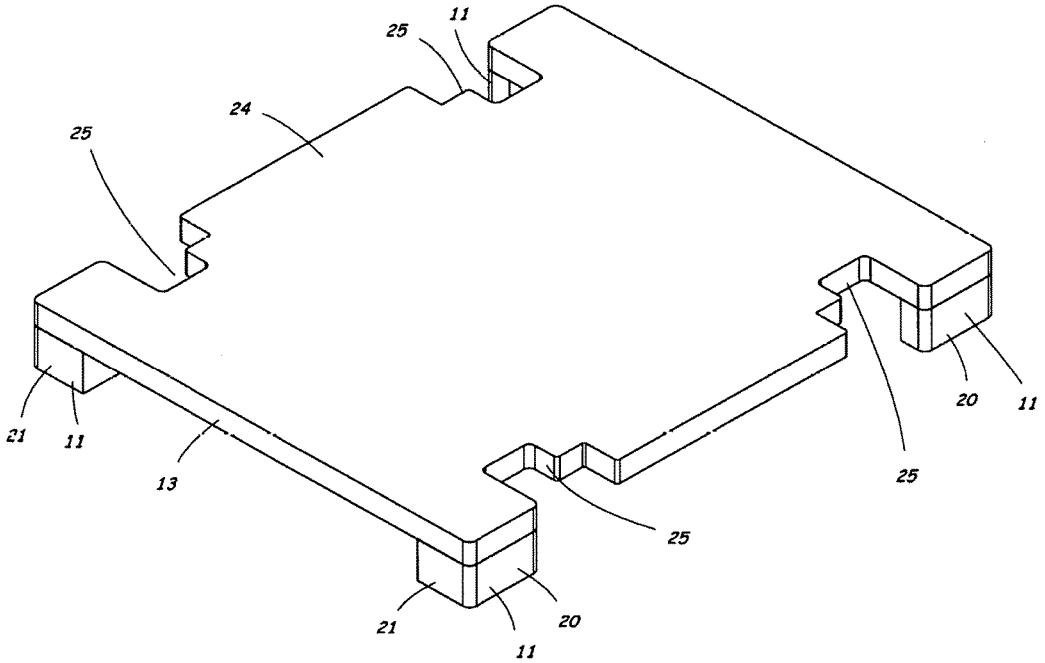
FIG. 1 is a perspective view of a nestable block pallet according to a first embodiment of the present invention.
Figure 2:
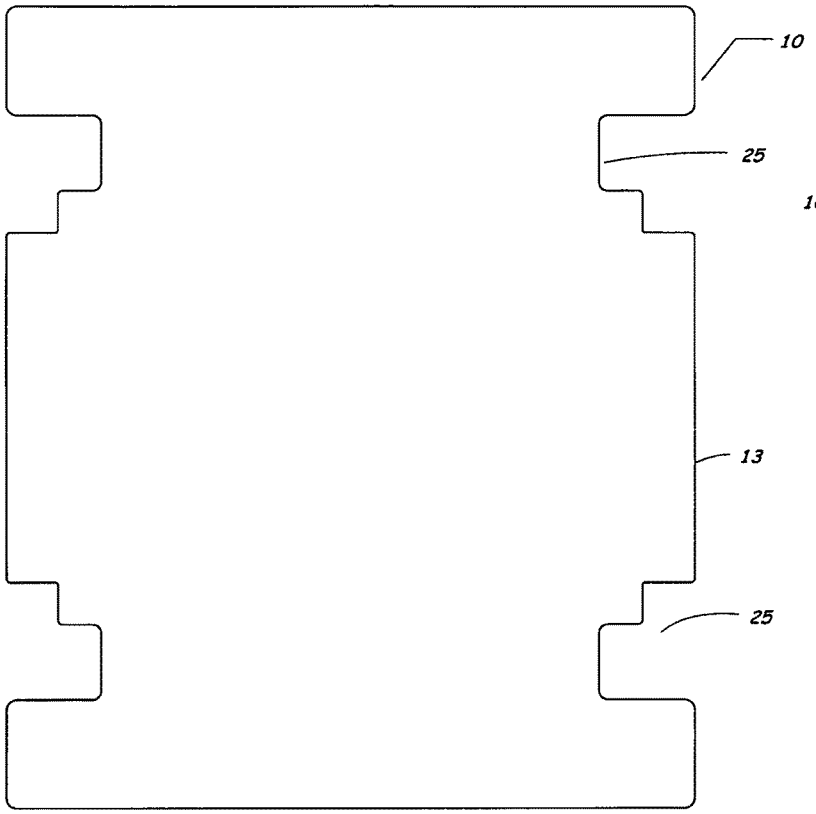
FIGS. 2 to 4 are plan, front and side views, respectively, of the block pallet shown in FIG. 1.
Figure 4:
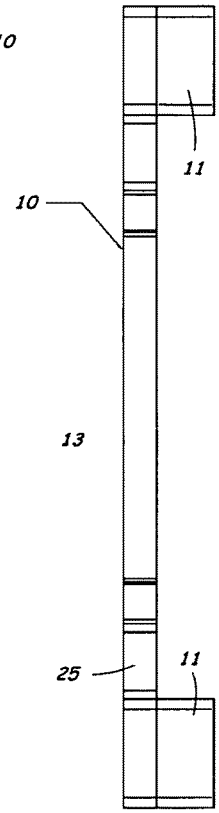
Figure 3:
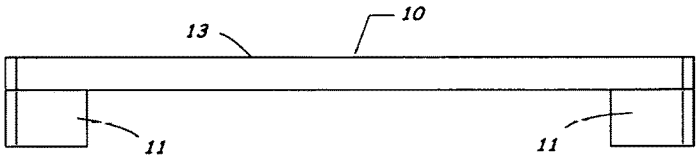
Figure 5:
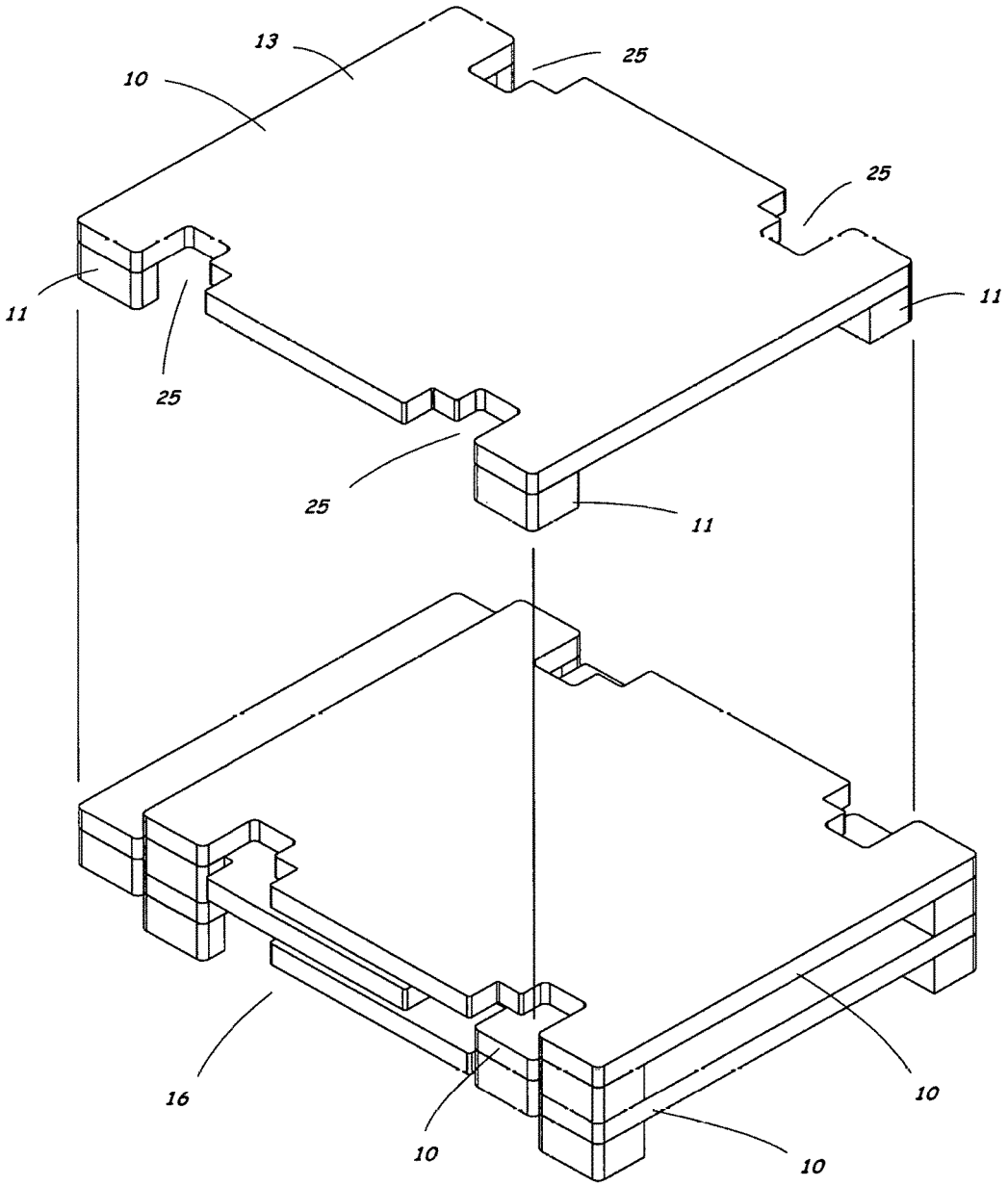
FIG. 5 is a perspective view of a stack of nestable block pallets according to the first embodiment of the present invention.
Figure 6:
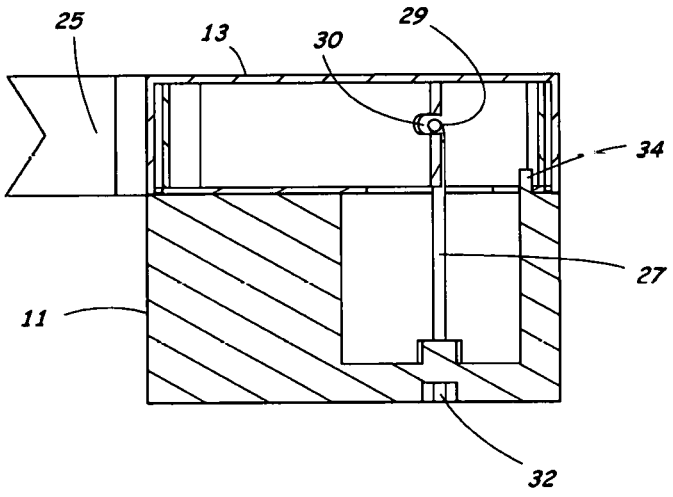
FIGS. 6 and 7 are cross section views of a corner portion of the block pallet with a detachable foot according to the first embodiment of the present invention.
Figure 7:
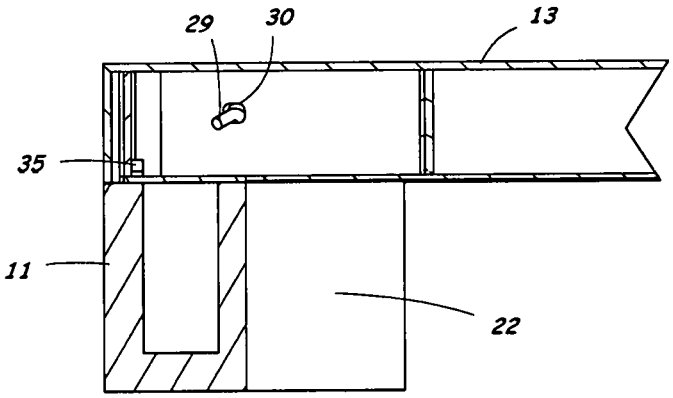
Figure 8:
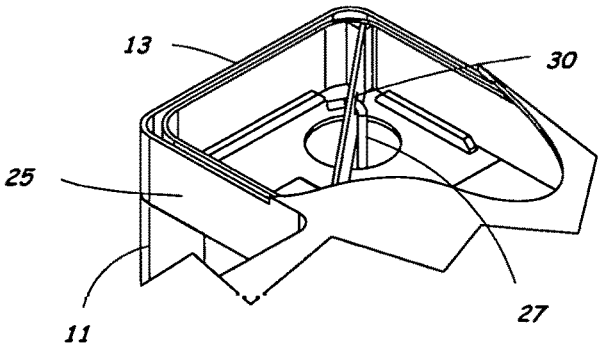
FIG. 8 is a cutaway perspective view of a corner portion of the block pallet with the detachable foot.
Figure 9:
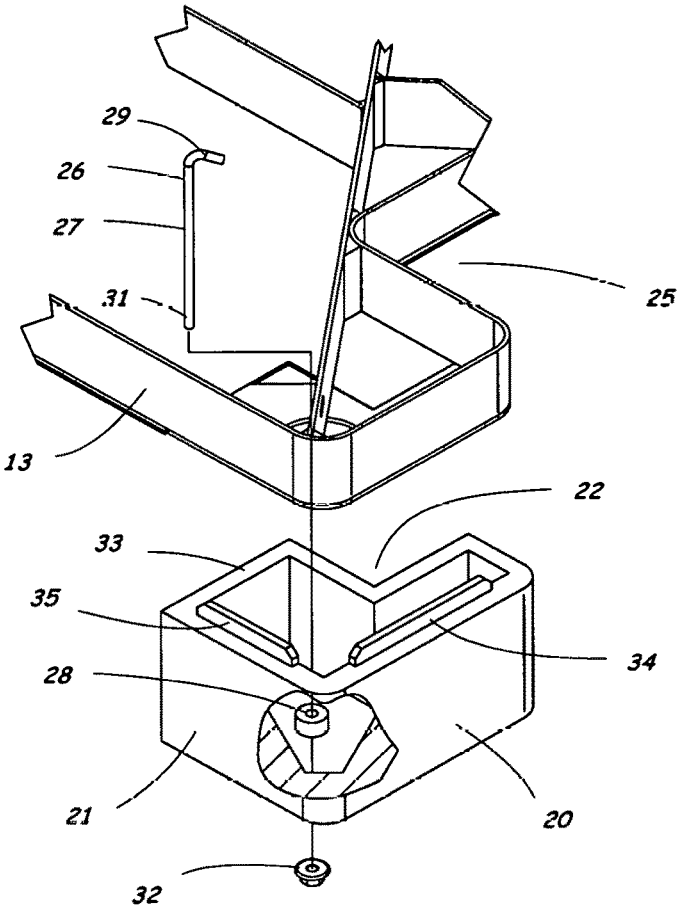
FIG. 9 is an exploded perspective view of the corner portion of the block pallet with the detachable foot.
Figure 10:
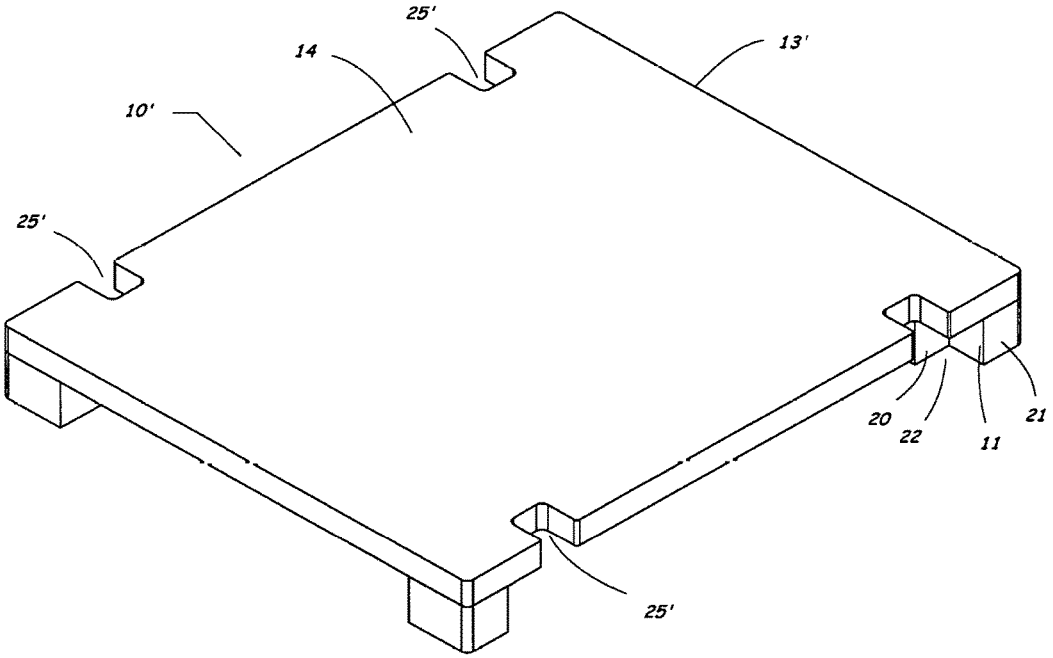
FIG. 10 is a perspective view of a nestable block pallet according to a second embodiment of the present invention.
Figure 11:
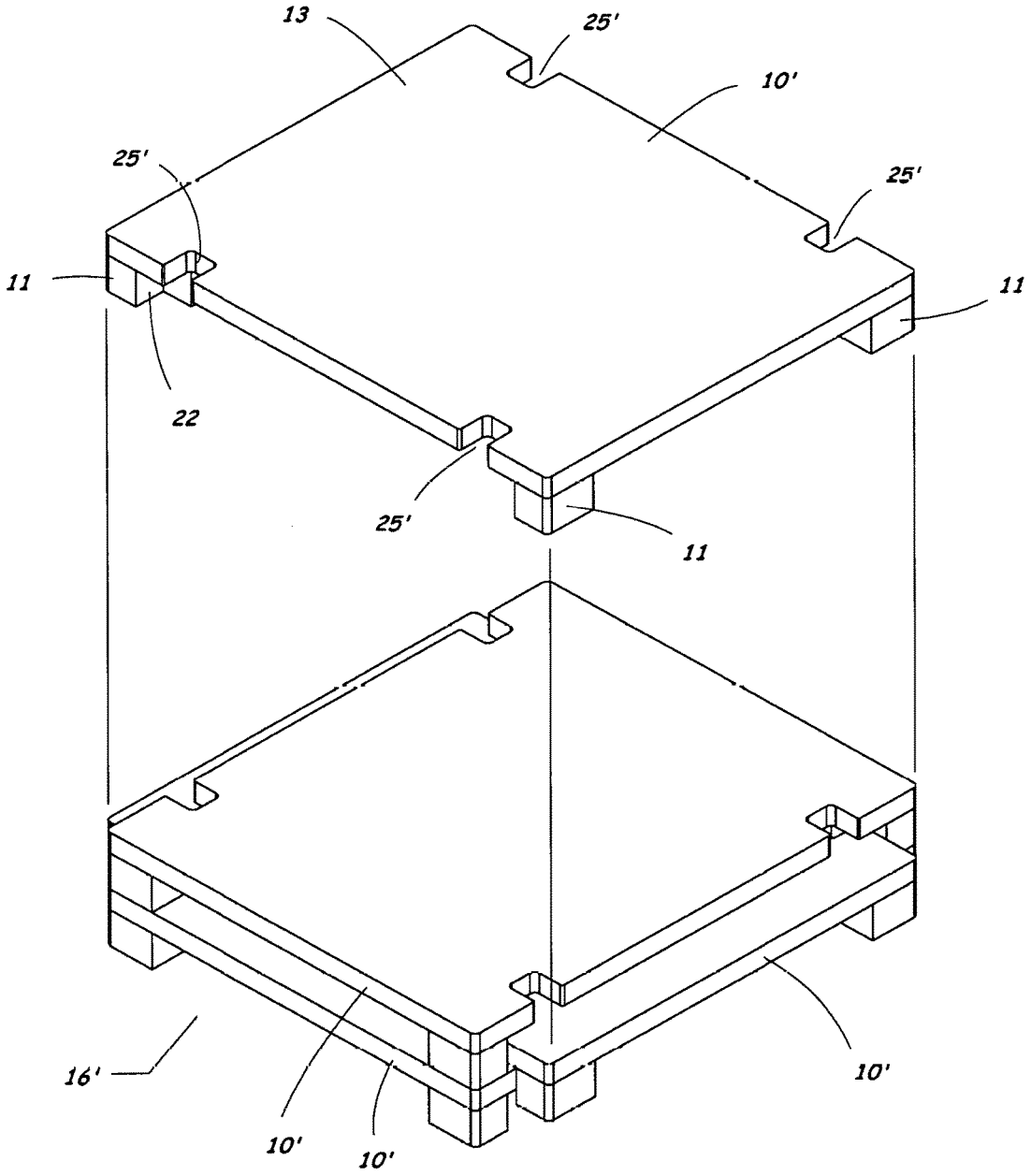
FIG. 11 is a perspective view of a stack of nestable block pallets according to the second embodiment of the present invention.
Figure 12:
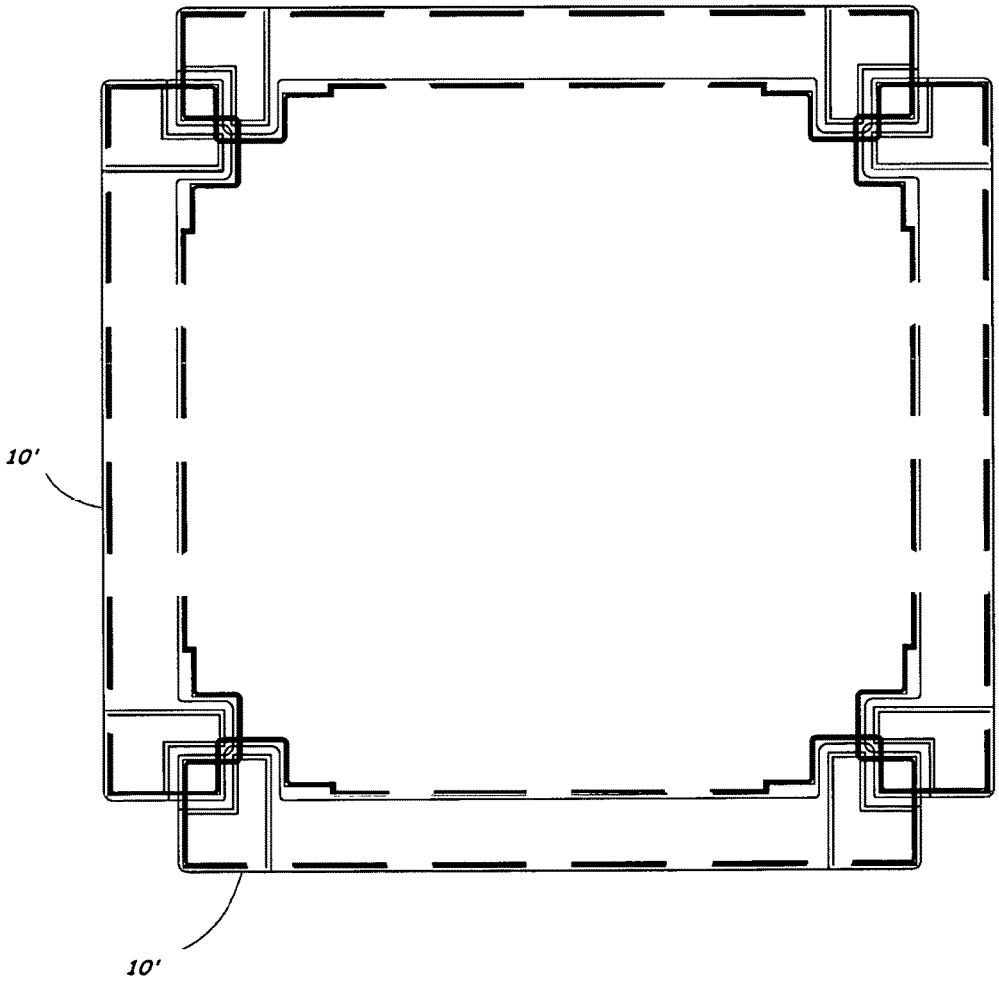
FIG. 12 is a plan view of the stack of block pallets shown in FIG. 11.
Figure 13:
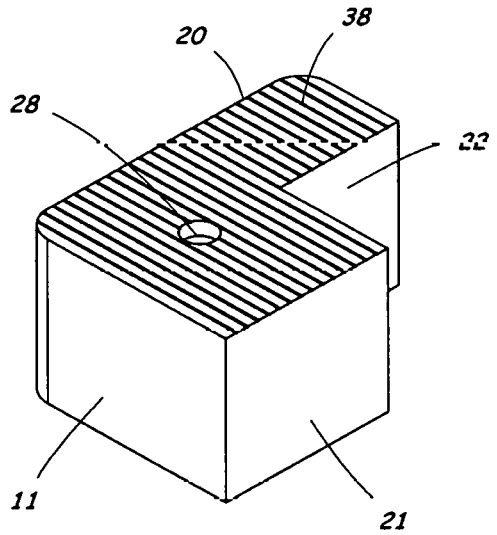
FIGS. 13 to 16 are perspective views of the detachable foot.
Figure 14:
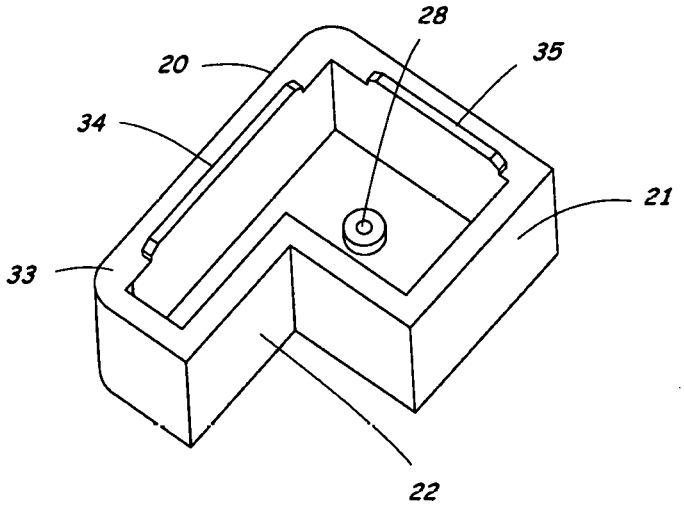
Figure 15:
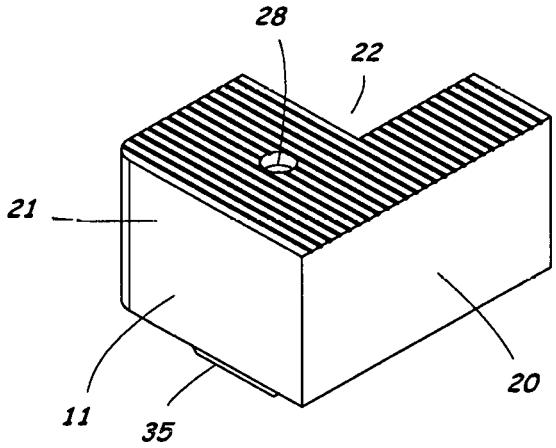
Figure 16:
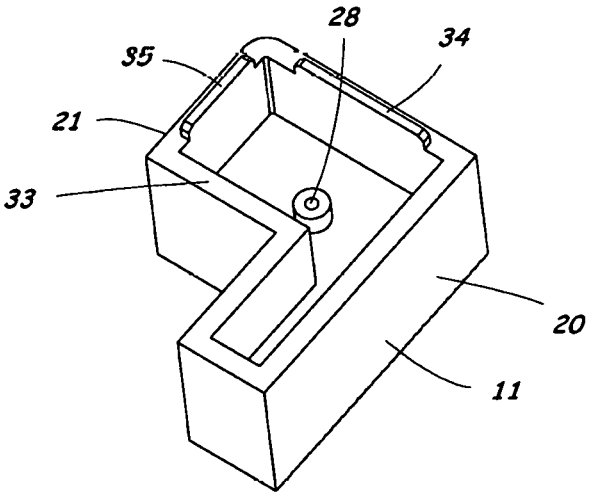
Figure 17:
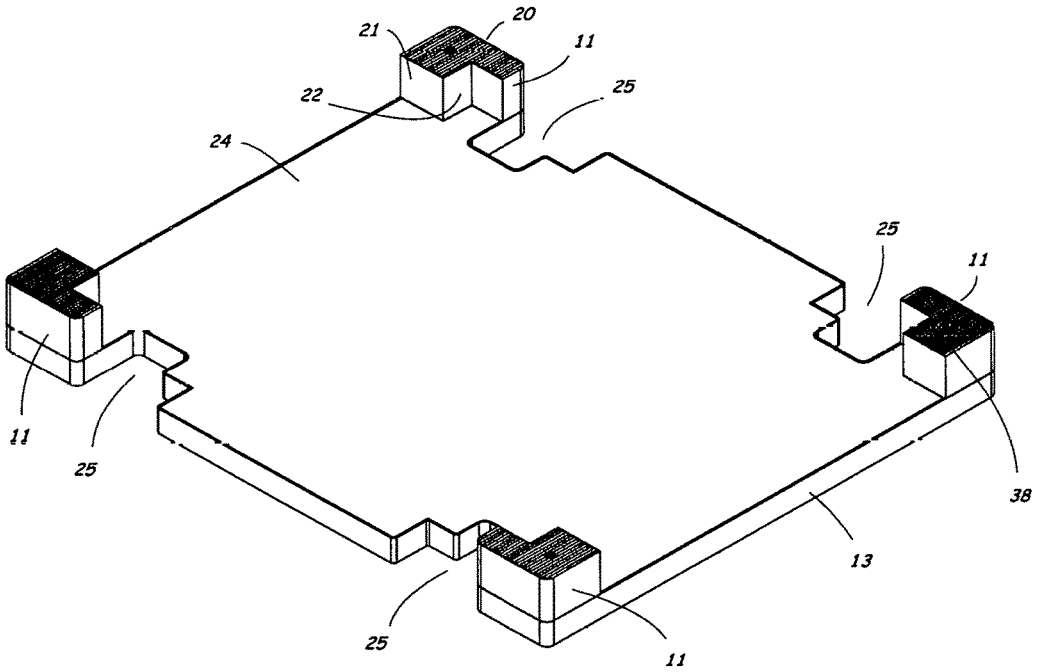
FIG. 17 is a perspective bottom view of the nestable block pallet according to the first embodiment of the present invention.
Figure 18:
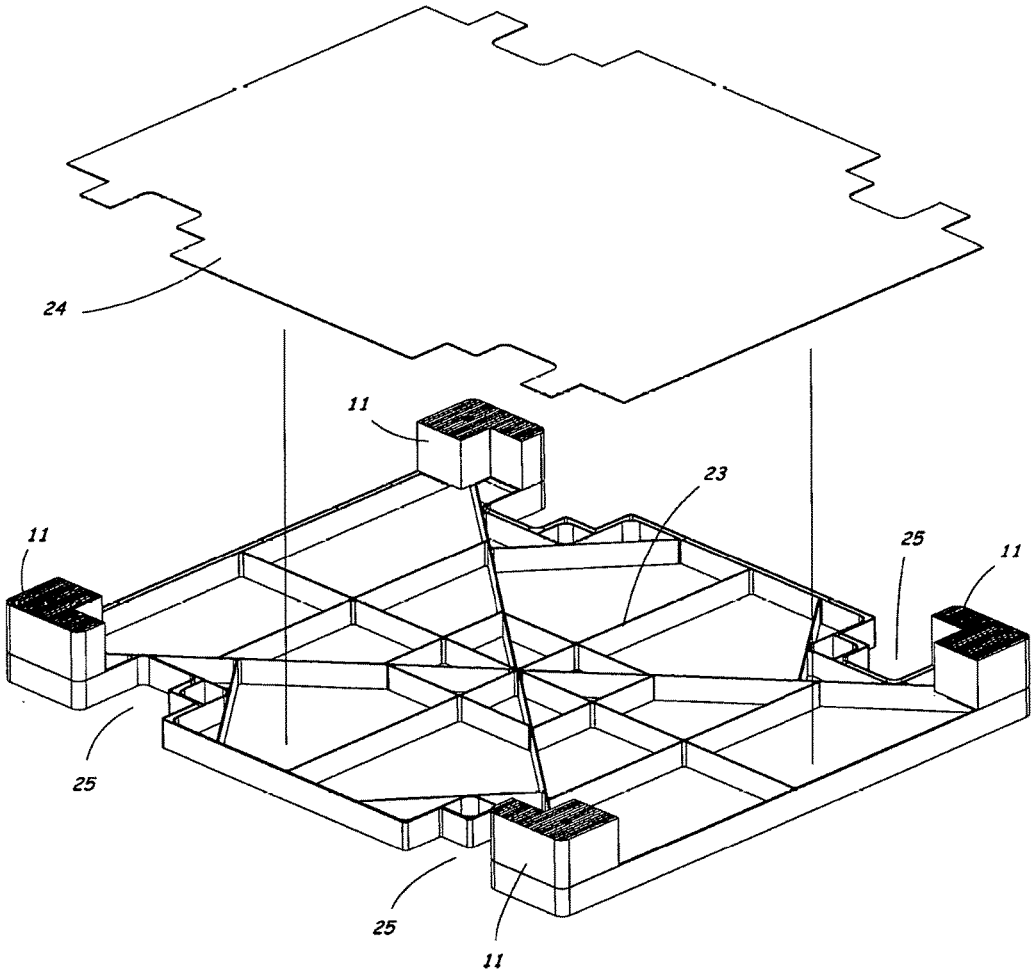
FIG. 18 is a perspective bottom view of the nestable block pallet shown in FIG. 17, with a lower cover in exploded view to show the metal reinforcement frame inside the pallet deck.
Figure 19:
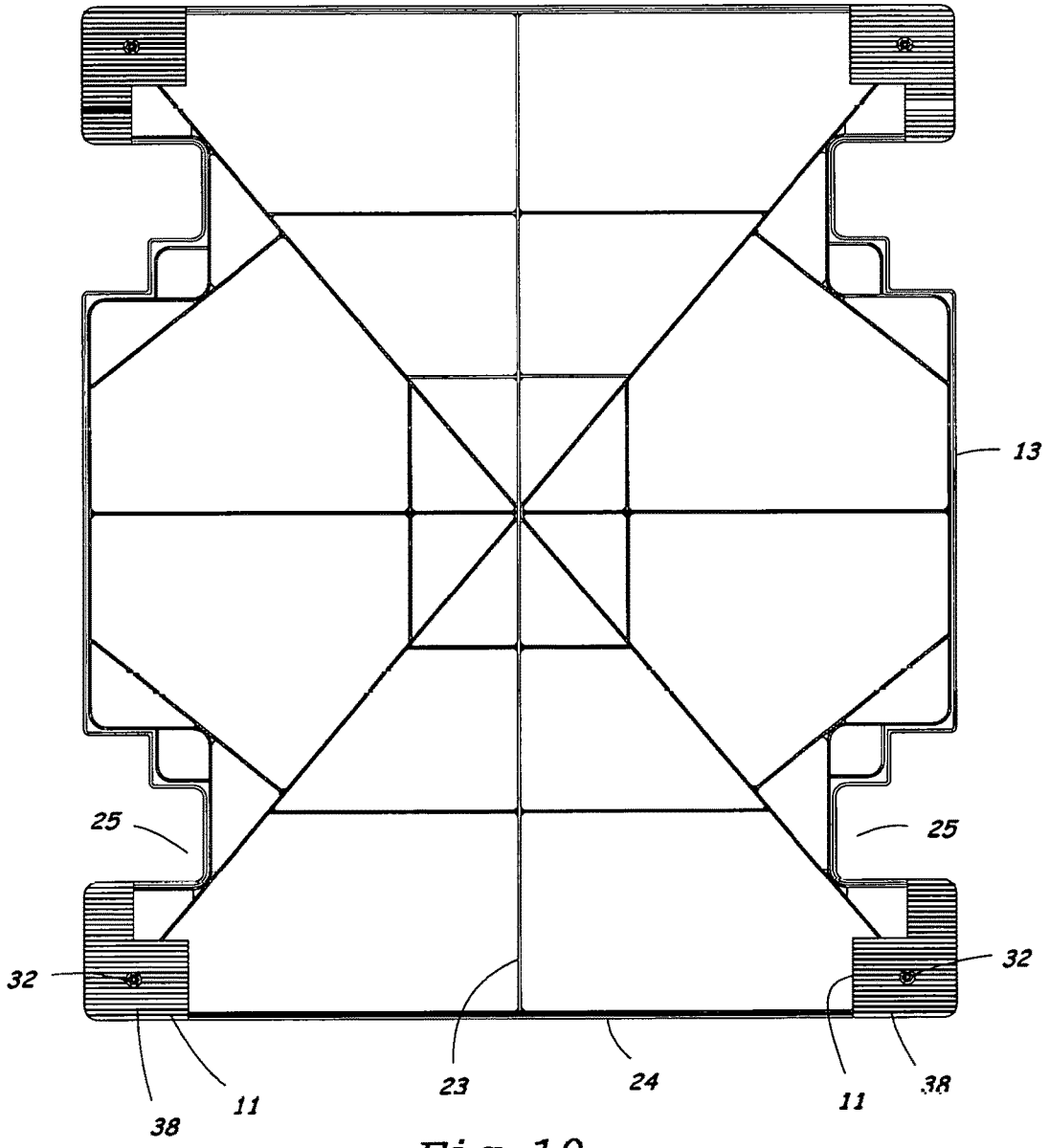
FIG. 19 is a bottom view of the nestable block pallet shown in FIG. 17, with the lower cover removed to show the metal reinforcement frame inside the pallet deck.
Figure 20:
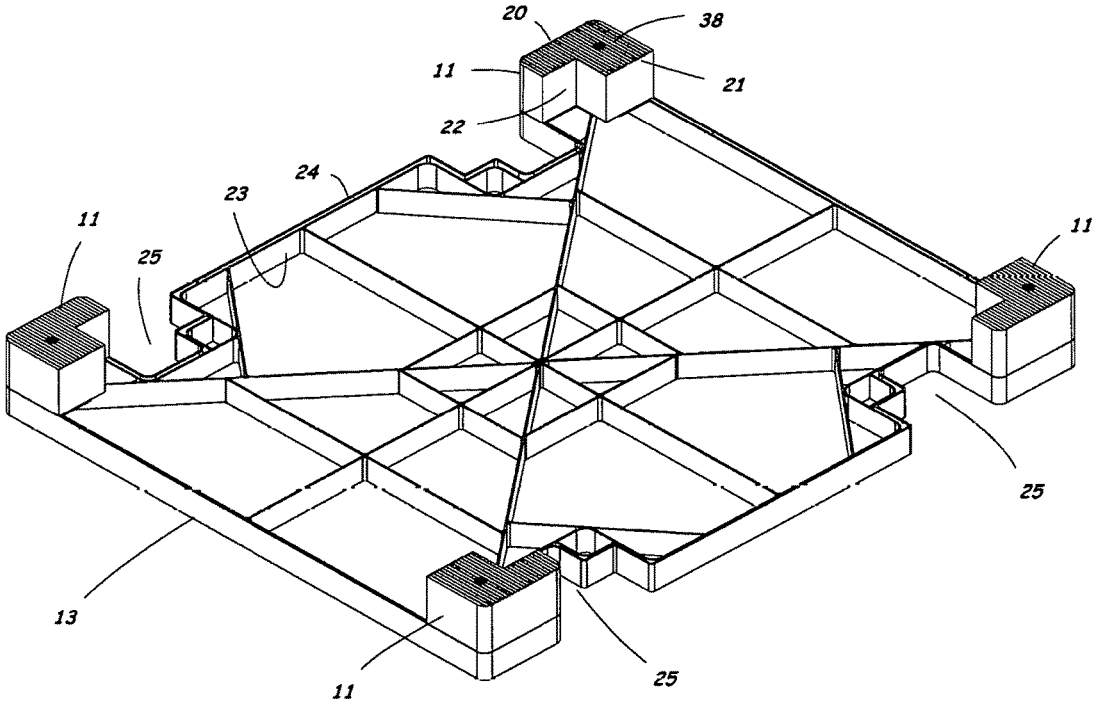
FIG. 20 is a perspective bottom view of the nestable block pallet shown in FIG. 17, with the lower cover removed to show the metal reinforcement frame inside the pallet deck.
Figure 21:
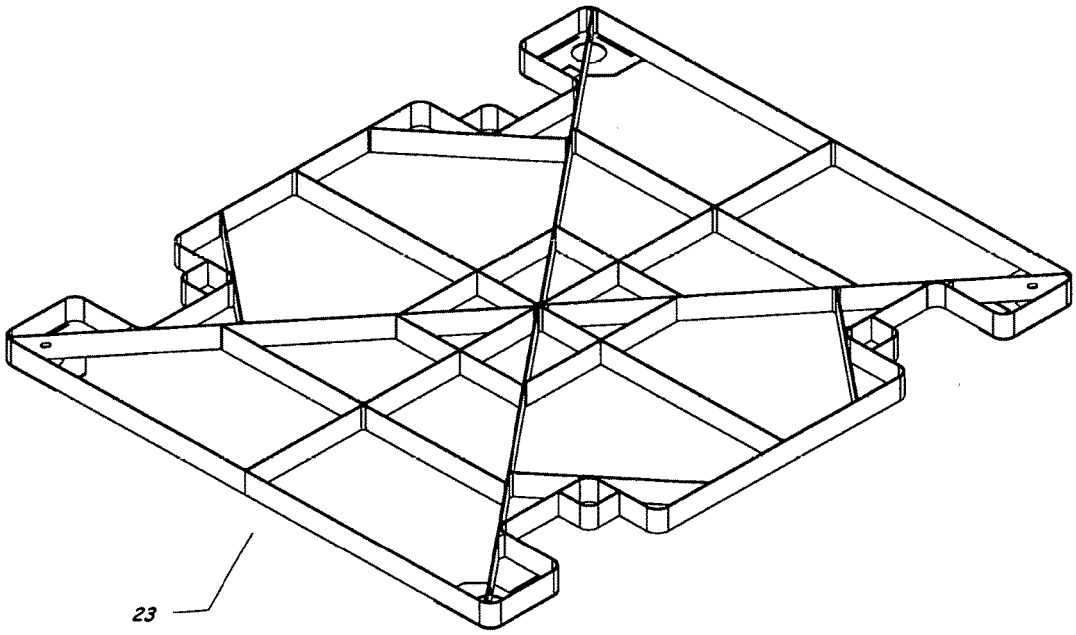
FIG. 21 is a perspective view of the metal reinforcement frame used in the pallet deck.
Figure 22:
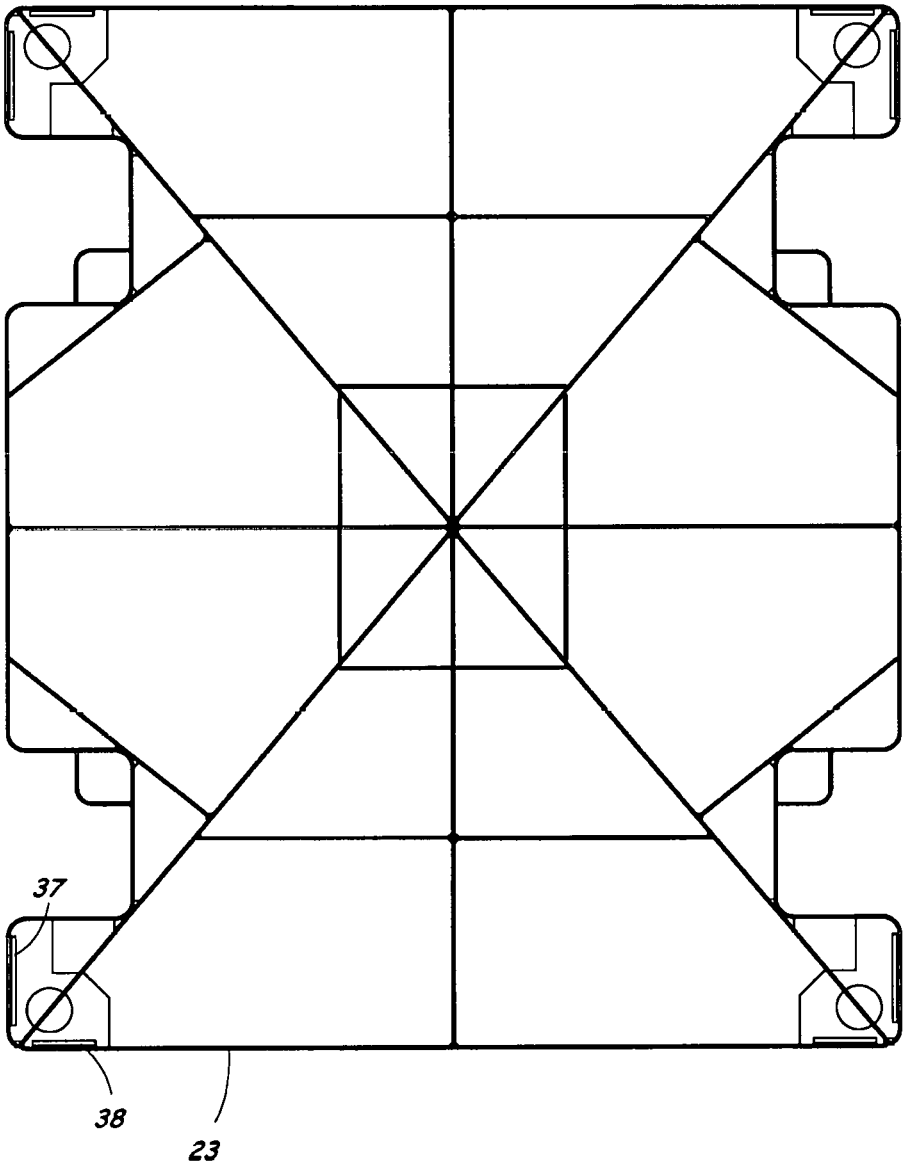
FIG. 22 is a plan view of the metal reinforcement frame used in the pallet deck.
Figure 23:
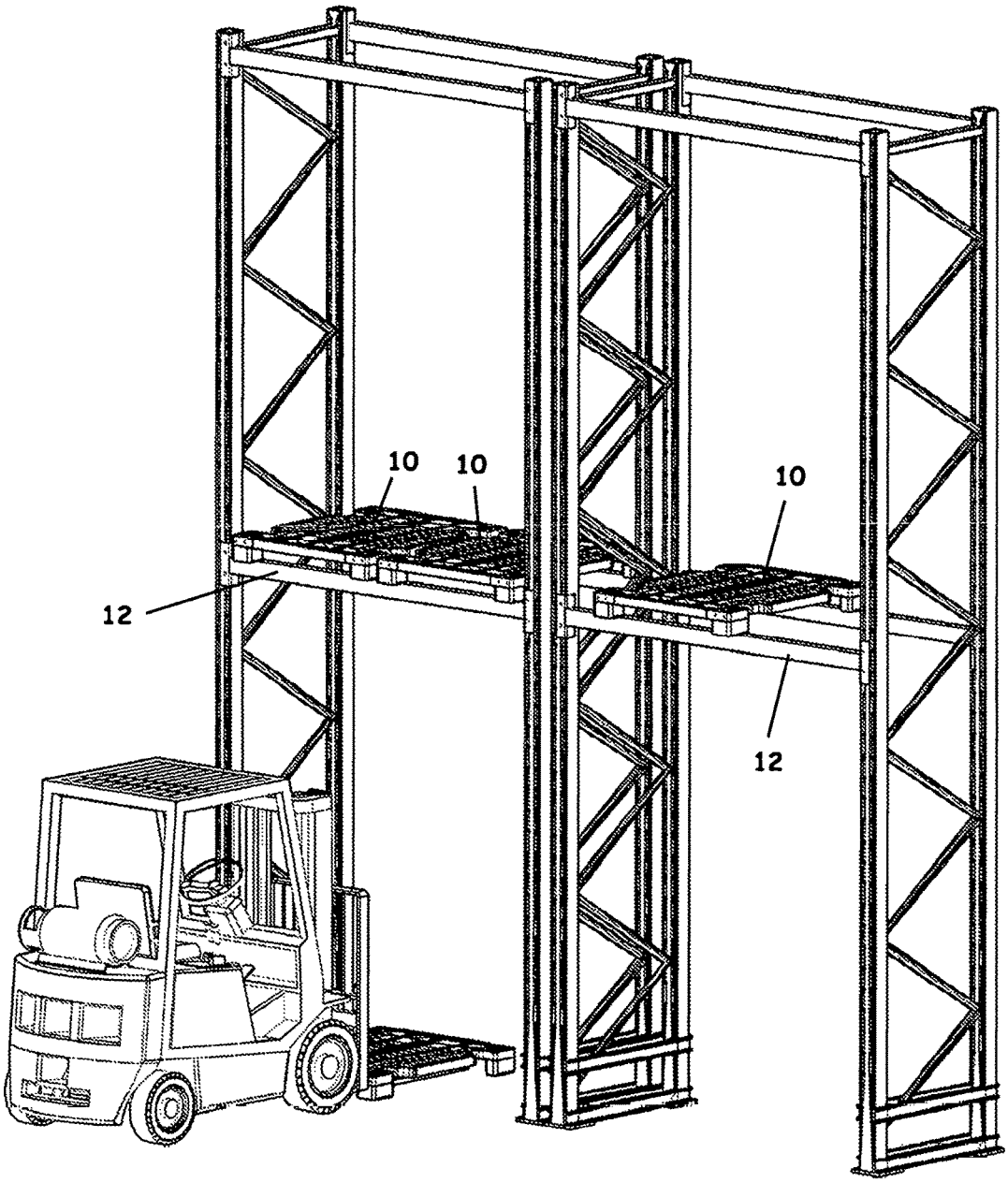
FIG. 23 is a perspective view of a fork lift and storage rack with nestable block pallets supported on the storage rack by pallet feet located at the corners of the pallets.

Two embodiments of a nestable block pallet 10, 10' according to the present invention are illustrated in the drawings. A pallet 10 according to the first embodiment is illustrated in FIGS. 1 to 5 and 17 to 22; and a pallet 10' according to the second embodiment is illustrated in FIGS. 10 to 12. Replaceable feet 11 for the block pallets 10, 10' are shown in FIGS. 6 to 9 and 13 to 16.

The present invention provides a quad foot nestable block pallet 10, 10' that uses a four corner block foot construction. Nestable pallets 10, 10' fit together when empty, thereby reducing the amount of space needed for storage. The block foot construction allows the pallets 10, 10' to be compatible with and sit on a standard pallet rack 12 designed for an industry standard 40 inch×48 inch pallet.

The block pallet 10 has a rectangular pallet deck 13 with a generally planar upper surface 14. A plurality of pallet feet 11 are arranged to support the pallet deck 13 at the four corners of the pallet deck 13. In the preferred embodiments, the pallet 10 has only four pallet feet, which are located at each of the four corners of the pallet deck 13. The pallet 10 is open on a bottom side 15 with a clear span between the pallet feet 11 to allow multiple pallets 10 to be nested together in a stack 16. The pallet deck 13 has sufficient strength that no additional supports are necessary between the pallet feet 11 at the four corners.

The pallet feet 11 each have an upper end 17 and a lower end 18. The pallet feet 17 protrude downwardly from the four corners of the pallet deck 13 with the upper ends 17 of the pallet feet 11 engaging the pallet deck 13. The lower ends 18 of the pallet feet 11 engage a support surface, such as a floor or support rack 12, on which the pallet 10 is supported. The pallet feet 11 are only connected to each other via the pallet deck 13, thereby leaving a clear span between the lower ends of the pallet feet 11 to allow multiple pallets 10 to be nested together in a stack 16.

The pallet has an overall height and an opening height below the pallet deck 13 sufficient to insert forks of a forklift 19 for lifting and moving the pallet 10. For example, the overall pallet height can be approximately 5.5 inches, and the opening height below the pallet deck can be approximately 3.5 inches to meet the functional requirements of an industry standard pallet.

With the pallets 10 nested together, the total height of the stack 16 is substantially less than the combined heights of the individual pallets 10. For example, in a stack of three nested pallets 10, the stack 16 will have a total height of approximately two times the height of one pallet 10. In a stack of five nested pallets 10, the stack 16 will have a total height of approximately three times the height of one pallet 10.

The pallet 10 has a length and a width, and the length is greater than the width. For example, to match the industry standard pallet size, the pallet length can be approximately 48 inches, and the pallet width can be approximately 40 inches.

The pallet feet 11 are each L-shaped in plan view with a long side 20, a short side 21, and a notch 22. The pallet feet 11 are each arranged with the long side 20 extending in a direction of the length of the pallet 10, and the short side 21 extending in a direction of the width of the pallet 10. In the first embodiment, the pallet feet 11 are arranged with the notches 22 facing inwardly toward each other. In the second embodiment, the pallet feet 11 are arranged with the notches 22 facing outwardly away from each other.

The block pallet 10 according to the present invention combines the strength from a conventional top and bottom board pallet into a rigid single deck 13 with minimal deflection and eliminates the need for a bottom support under the block feet 11. This elimination of the bottom support allows for a nestable block pallet 10. The pallet 10 also has openings on all four sides allowing four-way entry with the forks of a forklift 19.

In preferred embodiments, the pallet deck 13 is made of a metal reinforcement frame 23 covered by a plastic shell 24. The metal reinforcement frame 23 comprises a grid of flat metal elements that are welded or otherwise fastened together in a pattern to provide structural strength to support a load on the pallet deck 13 with a low amount of deflection. While a plastic reinforcement frame could be used instead of the metal reinforcement frame, a plastic frame without metal reinforcement will be more susceptible to material fatigue and sagging over an extended time period. The metal and plastic materials used in the pallets 10 will resist insects, bacteria and fungi, and will also allow the pallets to be recyclable. The upper surface 14 of the pallet deck 13 is etched to help prevent the pallet contents from slipping.

In the pallet 10 according to the first embodiment, holes 25 are strategically formed in the long sides of the pallet deck 13 between but adjacent to the locations where the pallet feet 11 are attached to the pallet deck 13. The holes 25 are cutouts in the sides of the pallet deck 13 and are substantially L-shaped in plan view with an open side facing outwardly from said pallet deck 13 to accommodate and correspond to the L-shaped pallet feet 11. The holes 25 are arranged to allow the block feet 11 of the second pallet 10 to slide through the deck 13 of the first pallet 10 directly behind the block feet 11 of the first pallet 10, and the other set of feet 11 to hang over the narrow end of the first pallet 10. This allows the pallets 10 to rest deck-to-deck without rotating adjacent pallets 10 in the stack 16 relative to each other.

The clear span construction of the pallet 10 allows the pallet feet 11 of the third pallet 10 on the stack 16 to rest on the first pallet deck 13 directly over the four block feet 11 of the first pallet 10 and allows a forklift space between the pallet decks 13 to enter and disassemble a stack of pallets 10. The pallet deck 13 of the second pallet 10 in the stack 16 is positioned between the pallet decks 13 of the first and third pallets 10. This stacking configuration is repeated, for example, until 35 pallets are put onto the stack 16, and will allow 910 pallets to be loaded in a standard 53 foot×102 inch×9 foot box trailer, which compares to a maximum of 540 conventional block pallets in the same trailer. The nested pallets 10 provide an improvement in space utilization and a substantial savings in transport costs to move empty pallets.

In the pallet 10' according to the second embodiment illustrated in FIGS. 10 to 12, the holes 25' are formed in the long sides of the pallet deck 13' between but adjacent to the locations where the pallet feet 11 are attached to the pallet deck 13'. The holes 25' are cutouts in the sides of the pallet deck 13 and are substantially rectangular in plan view with an open side facing outwardly from said pallet deck 13' to allow the pallets 10' to be nested when the second pallet 10' is turned a quarter of a turn. In this configuration, the second pallet 10' is turned 90 degrees and placed on the first pallet 10' with the feet 11 sliding through the holes 25' in the pallet deck 13' of the first pallet 10', and the second deck 13' resting on the top of the deck 13' of the first pallet 10'. The third pallet 10' on the stack 16' is then placed squarely on top of the first pallet 10' slipping through the holes 25' on the second pallet 10' and resting on the pallet deck 13' directly above the feet 11 of the first pallet 10'. This pattern is repeated, for example, until 35 pallets are put onto the stack 16'. A standard 53 foot×102inch×9 foot box trailer will hold 26 stacks and a total of 910 pallets.

The nestable block pallet feet 11 are separate components of the pallet construction. The feet 11 are detachable from the pallet deck 13, 13' and are connected to the pallet deck 13, 13' by shear members 26. The shear members 26 each include a rod 27 that extends vertically through a bore 28 in the pallet feet 11. The rod 27 has an upper end 29 with a hook for attaching to a hole 30 in the metal reinforcement frame 23 of the pallet deck 13 and a lower threaded end 31. A nut 32 is threaded onto the lower end 31 of the rod 27 to secure the pallet feet 11 to the pallet deck 13. Each shear member 26 will be able to absorb an impact of normal operating forces, but will shear and allow the feet 11 to detach upon encountering a greater force, such as a direct hit by a forklift fork. The feet 11 can be replaced easily if they are damaged by simply bolting on a new foot 11.

The pallet feet 11 each have a hollow construction with an upper rim 33 that engages a lower surface of the pallet deck 13. The hollow construction minimizes weight while maintaining the structural strength of the feet 11. First and second protrusions 34, 35 extend upwardly from the upper rim 33 of the pallet feet 11 to engage a corresponding structure 36, 37 on the bottom side of the pallet deck 13 to keep the pallet feet 11 aligned relative to the pallet deck 13. The protrusions 34, 35 are shearable to allow the feet 11 to move relative to the pallet deck 13 when the feet 11 encounter a force, such as a direct hit by a forklift fork. A plurality of grooves 38 are formed in a bottom surface of the pallet feet 11 to provide a gripping foot tread.

The upper surface 14 of the pallet deck can be provided with a raised bead around the edge of the pallet deck 13. Additional raised beads can be provided at spaced intervals across the pallet deck 13. The raised beads can reduce the slip coefficient and help prevent products from slipping off of the pallet 10, 10'.

The nestable block pallets 10, 10' according to the present invention have several unique features, some of which are described below:

1. Nestable Pallet Deck (first embodiment). The pallet 10 according to the first embodiment can be nested so that the pallet 10 overhangs on the narrow (i.e., 40 inch) side of the 40 inch×48 inch pallet creating a 40 inch×54 inch footprint. L-shaped holes 25 are provided in the deck 13 of the pallet 10 for the foot 11 of the next pallet 10 to slip through and the deck 13 of the second pallet 10 to rest on the deck 13 of the first pallet 10. The third pallet 10 moves back to sit directly on top of the first pallet 10 again slipping through the L-shaped hole 25 in the deck 13 of the second pallet 10 directly on top of the first pallet 10. This pattern is repeated until 35 pallets are put onto the stack 16. A standard swing door 53 foot long dry van trailer will hold 26 stacks for a total of 910 pallets. The nestable pallets 10 of the first embodiment can thus be used in a pallet pooling system with increased transportation efficiencies between pallet users and shippers.

2. Nestable Pallet Deck (second embodiment). The pallet 10' according to the second embodiment can be nested so that the pallet 10' overhangs the long (i.e., 48 inch) side of the 40 inch×48 inch pallet creating a 48 inch×48 inch foot print. A square hole 25' is provided in the deck 13' of the pallet 10' adjacent to each of the four pallet feet 11. For example, a square 3 inch×3 inch hole 25' may be provided in the deck 13' of the pallet 10'. The second pallet 10' is turned a quarter of a turn and is placed on the first pallet 10' with the feet 11 sliding through the pallet deck 13' and the second deck 13' resting on the top of the deck 13' of the first pallet 10'. The third pallet 10' is then placed squarely on top of the first pallet 10' slipping through the holes 25' on the second pallet 10' and resting on the pallet deck 13' directly above the feet 25' of the first pallet 10'. This pattern is repeated until 35 pallets are put onto the stack 16'. A standard swing door 53 foot long dry van trailer will hold 26 stacks for a total of 910 pallets. The nestable pallets 10' of the second embodiment can thus be used in a pallet pooling system with increased transportation efficiencies between pallet users and shippers.

3. Pallet Deck Construction. The pallet deck 13, 13' has a reinforcement metal frame 23 inside a plastic shell 24. The upper deck surface 14 is etched to prevent pallet contents from slipping off the surface 14. The underneath side of the pallet 10, 10' is closed by the plastic shell 24.

4. Shearable/Replaceable Foot. The shearable foot 11 allows the foot 11 of the pallet 10, 10' to become detached from the pallet deck 13, 13' by shearing off the shear members 26, 33, 34 used to connect the foot 11 to the deck 13, 13'. For example, the plastic protrusions 33, 34 on the upper rims 32 of the feet 11 keep the feet 11 aligned and in place, and the threaded shear member 26 holds the foot 11 to the deck 13, 13'. The plastic protrusions 33, 34 are also designed to shear prior to damaging the pallet deck 13, 13'. The protrusions 33, 34 can then be removed from the pallet deck 13, 13', and a new foot 11 can be attached to the pallet deck 13, 13'.

5. L-Shaped Foot. The L-shaped foot 11 allows more deck surface to be available to support the pallet contents while still allowing the pallet feet 11 to slip through the deck top 13, 13' and the pallets 10, 10' to nest together. For example, the L-shaped foot 11 can be 5 inches on the short side 21, 6½ inches on the long side 20, and have a notch 22 of 2½ inches×2½ inches. In the first embodiment the notch 22 is provided on the inside of the pallet foot 11, and in the second embodiment the notch 22 is provided on the outside of the pallet foot 11 (e.g., the same pallet feet 11 can be used in the first and second embodiments, but rotated 180 degrees so that the notch 22 faces inwardly in the first embodiment and outwardly in the second embodiment).

6. Rack Gripping Foot Tread. The bottom of each of the feet 11 have a series of deep grooves 35 for gripping the rack bars 12 and preventing the pallet 10, 10' from slipping out of the rack 12. The grooves 35 run parallel to the short side of the pallet 10, 10'.

7. Quad Foot Configuration. The nestable pallet 10, 10' of the present invention employs a quad foot configuration. The quad foot configuration utilizes an L-shaped foot 11 in each of the four corners of the pallet 10, 10'. The pallet deck 13, 13' is made to support the pallet 10, 10' and its contents up to 3,000 pounds with deflection of less than 3/16 inch. This eliminates the bottom boards required by conventional pallet construction to provide the necessary deck strength and allows easy entry for material handling equipment.

8. Nestable and Rackable Pallet. The present invention provides a pallet 10, 10' that combines the rackability of a block pallet allowing the pallet 10, 10' to be placed in a rack 12 for storage with the space saving features of a plastic nestable pallet. The L-shaped foot 11 provides a similar surface area as a block pallet so that pallets 10, 10' can be stored lengthways in a standard 42 inch rack or sideways in a 36 inch rack.

The following functional design requirements are met by the pallet 10, 10' of the present invention.

| Functional Design Requirements | |
|---|---|
| Cost | <$40.00 |
| Size | 48" × 40" (L × W) |
| Weight Capacity | 4,000 lbs. (floor) |
| Max Displacement in Max Load | <0.500" |
| Shipping Weight | <50 lbs |
| Type | Rackable/nestable |
| Feet | Four (4) only and removable/replaceable |
| Overall Height | 5.500" max. |
| Opening Height | 3.500" min. |
| Slip Resistance | Coefficient of Friction higher than wood surface |
| Material Type | HDPP Glass Filled (Deck)/HDPP (Foot) |
| FDA Approved Material | Yes |

The following additional design requirements are met by the pallet of the present invention.

| Design Requirements | |
|---|---|
| Section Properties | Resistant bending moment to <.500" displacement |
| Material Density | 0.040-0.043 lb/cu$^3$ |
| Total Mass | <50 lbs |
| Typical Load Parameter | 1200 to 1800 lbs normal to pallet top deck |
| Factor of Safety (Load) | >2X (4000 lbs current design) |
| Tensile Strength (Yield) | <12K psi |
| Flexure Modulus (ksi) | >1700 |
| Impact Strength, lzod | Not <4.0 ft-lbs/in |

The following material requirements are met by the plastic material used to make the pallet of the present invention.

| Material Requirements | |
|---|---|
| Physical Properties | |
| Glass Filler | 30% |
| Density | 0.040 lb/cu$^3$ |
| Mechanical Properties | |
| Impact Strength, lzod | 4.0 ft-lbs/in |
| Tensile Strength | 15500 psi |
| Tensile Modulus | 1.00 × 10$^6$ psi |
| Flexure Strength | 24000 psi |
| Flexure Modulus | 0.92 × 10$^6$ psi |

While the invention has been described in connection with specific embodiments thereof, it is to be understood that this is by way of illustration and not of limitation, and the scope of the appended claims should be construed as broadly as the prior art will permit.

What is claimed is:

1. A pallet comprising:

a rectangular pallet deck having a generally planar upper surface;

a plurality of pallet feet arranged to support the pallet deck at four corners of the pallet deck;

said pallet being open on a bottom side with a clear span between said pallet feet to allow multiple pallets to be nested together in a stack; and said pallet deck has first and second sides and cutouts in said first and second sides adjacent to each of the four corners and between locations where the pallet feet are attached to the pallet deck, said cutouts each having an open side facing outwardly from said pallet deck to allow pallet feet of other pallets to slide through the pallet deck when the pallets are nested in a stack;

wherein said plurality of pallet feet comprises only four pallet feet, with one of said pallet feet being located at each of the four corners of the pallet deck; and wherein each of said pallet feet is L-shaped in plan view with a long side, a short side, and a notch.

2. The pallet according to claim 1, wherein said pallet has a length and a width and the length is greater than the width, and wherein said pallet feet are each arranged with the long side extending in a direction of the length of the pallet and the short side extending in a direction of the width of the pallet.

3. The pallet according to claim 2, wherein said pallet feet are each arranged with the notches facing inwardly toward each other.

4. A pallet comprising:

a rectangular pallet deck having a generally planar upper surface;

a plurality of pallet feet arranged to support the pallet deck at four corners of the pallet deck; and said pallet being open on a bottom side with a clear span between said pallet feet to allow multiple pallets to be nested together in a stack;

wherein said plurality of pallet feet comprises only four pallet feet, with one of said pallet feet being located at each of the four corners of the pallet deck;

wherein each of said pallet feet is L-shaped in plan view with a long side, a short side, and a notch;

wherein said pallet has a length and a width and the length is greater than the width, and wherein said pallet feet are each arranged with the long side extending in a direction of the length of the pallet and the short side extending in a direction of the width of the pallet; and wherein said pallet feet are each arranged with the notches facing outwardly.

5. A pallet comprising:

a rectangular pallet deck having a generally planar upper surface;

a plurality of L-shaped pallet feet arranged to support the pallet deck at four corners of the pallet deck; and said pallet being open on a bottom side with a clear span between said pallet feet to allow multiple pallets to be nested together in a stack;

wherein holes are formed in said pallet deck adjacent to each of the four corners to accommodate pallet feet of other pallets when the pallets are nested in a stack;

wherein said pallet deck has first and second sides, and wherein said holes are formed in said first and second sides between locations where the pallet feet are attached to the pallet deck; and wherein said holes are substantially L-shaped in plan view to accommodate L-shaped pallet feet of an adjacent pallet when adjacent pallets in a stack are offset relative to each other.

6. A pallet comprising:

a rectangular pallet deck having a generally planar upper surface;

a plurality of pallet feet arranged to support the pallet deck at four corners of the pallet deck; and said pallet being open on a bottom side with a clear span between said pallet feet to allow multiple pallets to be nested together in a stack;

wherein said pallet feet are detachable from said pallet deck and connected to said pallet deck by shear members;

wherein each of said shear members comprises a rod that extends through a bore in the pallet feet, said rod having an upper end with a hook for attaching to a reinforcement frame of the pallet deck and a lower threaded end, and a nut threaded onto the lower end of the rod to secure the pallet feet to the pallet deck;

wherein each of said pallet feet has a hollow construction with an upper rim that engages a lower surface of the pallet deck, and first and second protrusions extending upwardly from the upper rim of said pallet feet that engage a corresponding structure on the pallet deck to keep the pallet feet aligned relative to the pallet deck.

7. A pallet pooling system, comprising:

a plurality of nestable block pallets, each pallet comprising a rectangular pallet deck having a generally planar upper surface, a plurality of pallet feet arranged to support the pallet deck at four corners of the pallet deck, and an open bottom side with a clear span between said pallet feet to allow multiple pallets to be nested together in a stack;

said block pallets are arranged in a stack for transport with adjacent pallets nested together so that a height of the stack is substantially less than a sum of individual heights of the pallets in the stack; and said pallet deck has first and second sides and cutouts in said first and second sides adjacent to each of the four corners and between locations where the pallet feet are attached to the pallet deck, said cutouts each having an open side facing outwardly from said pallet deck to allow pallet feet of other pallets to slide through the pallet deck when the pallets are nested in a stack.

8. The pallet pooling system according to claim 7, wherein said block pallets are nested together by offsetting adjacent pallets in the stack in a longitudinal direction.

9. A pallet pooling system, comprising:

a plurality of nestable block pallets, each pallet comprising a rectangular pallet deck having a generally planar upper surface, a plurality of pallet feet arranged to support the pallet deck at four corners of the pallet deck, and an open bottom side with a clear span between said pallet feet to allow multiple pallets to be nested together in a stack; and said block pallets are arranged in a stack for transport with adjacent pallets nested together so that a height of the stack is substantially less than a sum of individual heights of the pallets in the stack;

wherein said block pallets are nested together in a stack with adjacent pallets in the stack rotated a quarter of a turn relative to each other.

* * * * *